US010598075B2

(12) United States Patent
Iida

(10) Patent No.: US 10,598,075 B2
(45) Date of Patent: Mar. 24, 2020

(54) COOLING DEVICE FOR ADDITIVE INJECTION VALVE AND COOLING SYSTEM

(71) Applicant: DENSO CORPORATION, Kariya, Aichi-pref. (JP)

(72) Inventor: Junya Iida, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/227,223

(22) Filed: Dec. 20, 2018

(65) Prior Publication Data

US 2019/0195118 A1 Jun. 27, 2019

(30) Foreign Application Priority Data

Dec. 25, 2017 (JP) ..... 2017-248242

(51) Int. Cl.
*F01P 3/12* (2006.01)
*F01N 3/04* (2006.01)
*F01N 3/20* (2006.01)

(52) U.S. Cl.
CPC ..... *F01P 3/12* (2013.01); *F01N 3/043* (2013.01); *F01N 3/206* (2013.01); *F01N 2610/02* (2013.01); *F01N 2610/11* (2013.01); *F01N 2610/1453* (2013.01)

(58) Field of Classification Search
CPC .. F01P 3/12; F01N 3/206; F01N 3/043; F01N 2610/1453; F01N 2610/11; F01N 2610/02
See application file for complete search history.

(56) References Cited

U.S. PATENT DOCUMENTS 5,605,042 A * 2/1997 Stutzenberger .... B01D 53/9431 60/286
7,043,922 B2 5/2006 Thompson et al.
8,881,995 B2 11/2014 Prociw et al.
8,973,355 B2 3/2015 Shovels
9,284,871 B2 3/2016 Knittel et al.
9,518,592 B2 12/2016 Wright et al.
2013/0228231 A1* 9/2013 Nagel ..... F01N 3/2066 137/334
2014/0299202 A1 10/2014 Winkler et al.
2014/0311130 A1* 10/2014 Knittel ..... F01N 3/2066 60/285
2015/0027108 A1 1/2015 Winkler et al.
2015/0059320 A1* 3/2015 Winkler ..... F01N 3/2066 60/295
2016/0053650 A1 2/2016 Seitz et al.
2016/0305298 A1* 10/2016 Murst ..... F01N 3/2066
2017/0363053 A1 12/2017 Ichihashi et al.

FOREIGN PATENT DOCUMENTS

DE 102009047375 6/2011
EP 2725227 5/2015
GB 358779 A * 10/1931 ..... F02M 53/043
GB 752913 A * 7/1956 ..... F02M 53/04
JP 09096212 A * 4/1997 ..... F01N 3/2066
JP 10-159559 6/1998

* cited by examiner

*Primary Examiner* — Hung Q Nguyen
(74) *Attorney, Agent, or Firm* — Nixon & Vanderhye P.C.

(57) ABSTRACT

A cooling device for an additive injection valve is connected to a circulation circuit for coolant in parallel with a different cooling device. The cooling device includes a coolant path through which the coolant flows, and a movable member that receives a flow of the coolant and shifts to vary a passage area of a predetermined portion of the coolant path.

10 Claims, 8 Drawing Sheets

COOLING DEVICE FOR ADDITIVE INJECTION VALVE AND COOLING SYSTEM

CROSS REFERENCE TO RELATED APPLICATION

This application is based on Japanese Patent Application No. 2017-248242 filed on Dec. 25, 2017, the disclosure of which is incorporated herein by reference in its entirety.

TECHNICAL FIELD

The present disclosure relates to a cooling device which uses a coolant to cool an injection valve for injecting an additive.

BACKGROUND ART

A cooling device has a guide to guide cooling water (coolant) to a distal end of an injection valve where a temperature increase easily occurs.

SUMMARY

A cooling device according to the present disclosure is, for an additive injection valve, connected to a circulation circuit of coolant in parallel with a different cooling device, and includes: a coolant path through which the coolant flows; and a movable member that receives a flow of the coolant and shifts to vary a passage area of a predetermined portion of the coolant path.

DETAILED DESCRIPTION

Figure 1:
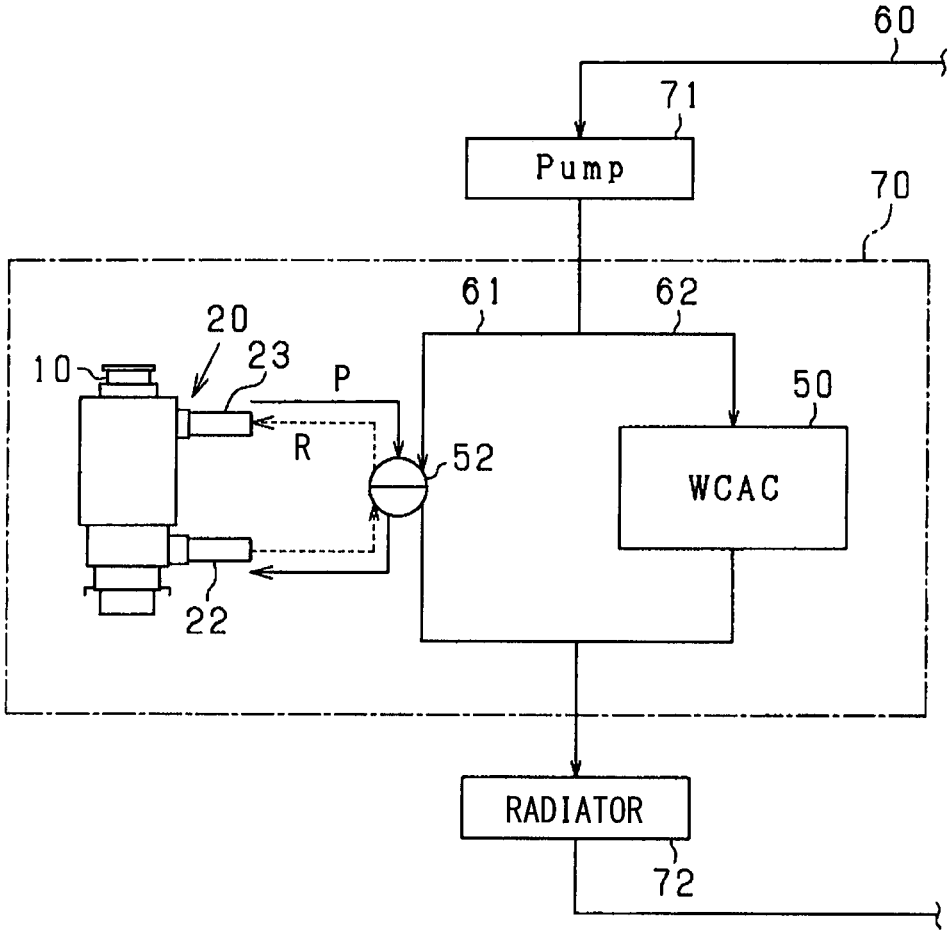
FIG. 1 is a schematic diagram illustrating a circulation circuit of cooling water and a cooling system.

A cooling system mounted on a vehicle according to an embodiment is hereinafter described with reference to the drawings. As illustrated in FIG. 1, a circulation circuit 60 for cooling water, a pump 71, a cooling system 70, a radiator 72, and others are mounted on a vehicle. The cooling system 70 is connected between the pump 71 and the radiator 72. The cooling system 70 includes a cooling device 20, a switcher 52, a water cooled charge air cooler (WCAC) 50, and others.

The pump 71 is connected to the circulation circuit 60, and circulates cooling water (coolant) through the circulation circuit 60 by utilizing a driving force of an internal combustion engine (not shown). A discharge amount of cooling water from the pump 71 is proportional to a rotation speed of the internal combustion engine. The pump 71 may be an electrically operated pump, and may be configured to change the discharge amount.

The circulation circuit 60 is branched into a branch path 61 and a branch path 62 on the downstream side of the pump 71. The switcher 52 is connected to the branch path 61. A first pipe 22 and a second pipe 23 of the cooling device 20 for an injection valve 10 are connected to the switcher 52. The switcher 52 switches a flow direction of cooling water flowing to the cooling device 20 between a normal direction P and an opposite direction R. Cooling water flowing in the normal direction (first direction) is introduced into the first pipe 22, and discharged from the second pipe 23. Cooling water flowing in the opposite direction (second direction) is introduced into the second pipe 23, and discharged from the first pipe 22.

The WCAC 50 is connected to the branch path 62. More specifically, the cooling device 20 and the WCAC 50 are connected to the circulation circuit 60 in parallel with each other. The WCAC 50 is a water-cooled intercooler.

The downstream side of the switcher 52 in the branch path 61 and the downstream side of the WCAC 50 in the branch path 62 are joined and connected to the radiator 72. The radiator 72 cools cooling water by heat exchange. Cooling water cooled by the radiator 72 circulates through the circulation circuit 60, and again flows toward the pump 71.

Figure 2:
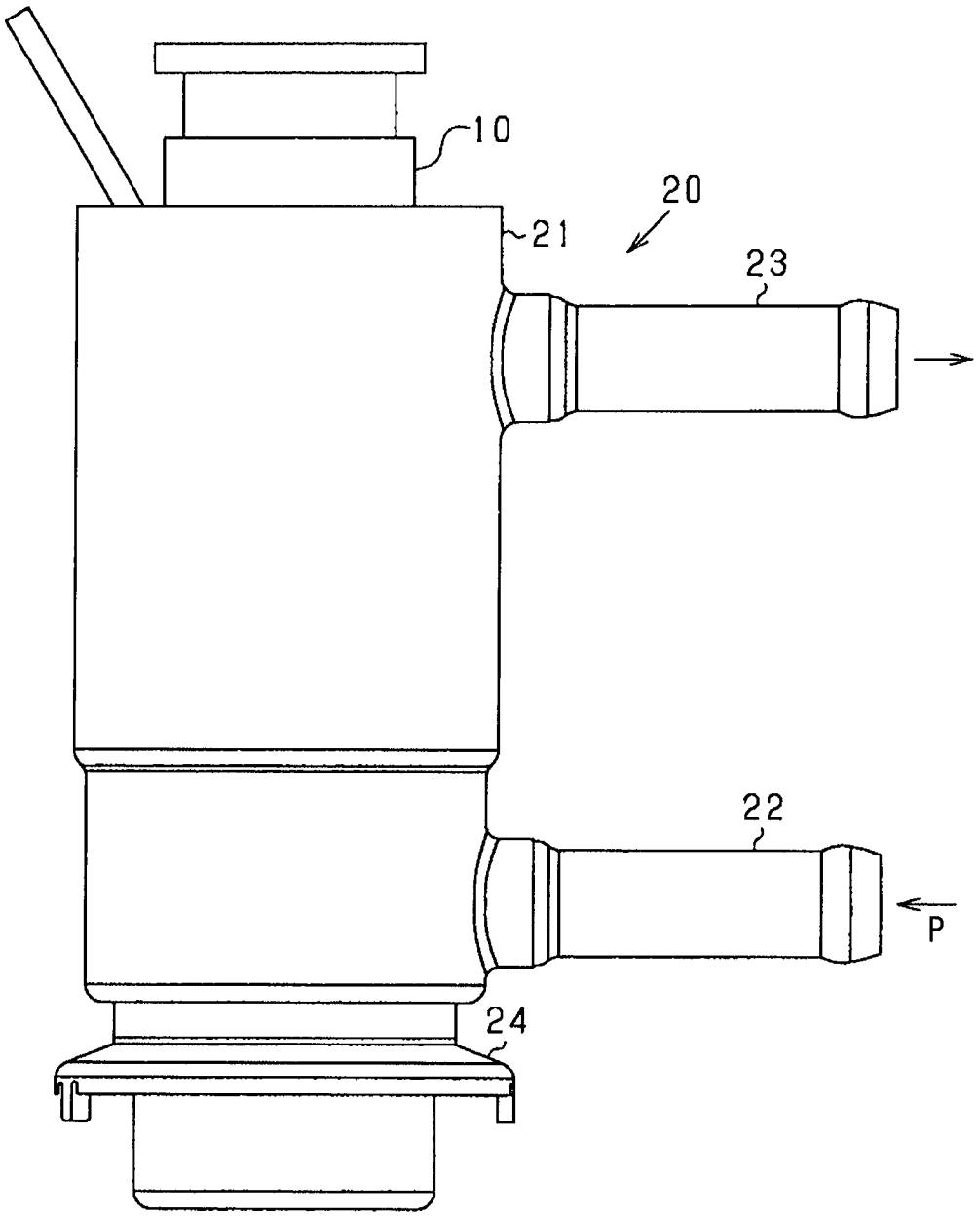
FIG. 2 is a front view illustrating an injection valve and a cooling device.
Figure 3:
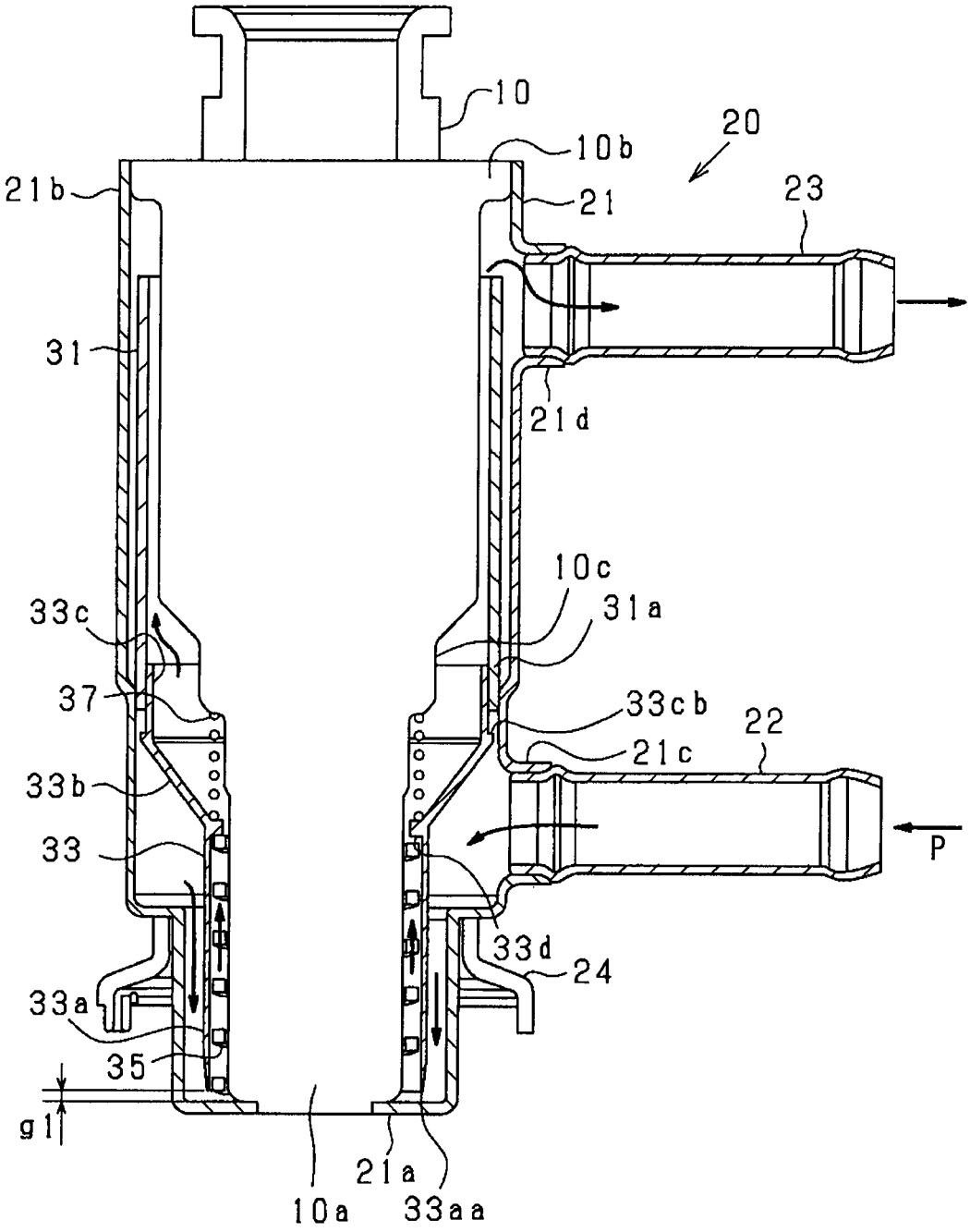
FIG. 3 is a partial cross-sectional view of FIG. 2 when a flow amount of cooling water is smaller than a predetermined flow amount.

As illustrated in FIGS. 2 and 3, the cooling device 20 (cooling device for additive injection valve) is attached to the injection valve 10. The injection valve 10 has a cylindrical shape. The injection valve 10 injects urea from a distal end 10*a*.

The cooling device 20 includes a body 21, the first pipe 22, the second pipe 23, a fixed member 31, a movable member 33, a first spring 35, a second spring 37, an attaching member 24, and others. The cooling device 20 is attached to an exhaust pipe of the internal combustion engine via the attaching member 24.

The body 21 has a cylindrical shape which has a diameter larger than a diameter of the injection valve 10. A first end 21*a* of the body 21 is joined to an outer circumferential surface of the distal end 10*a* of the injection valve 10. A second end 21*b* of the body 21 is joined to an outer circumferential surface of an enlarged diameter portion 10*b* (proximal end) of the injection valve 10. The body 21 includes a first port 21*c* and a second port 21*d*. The first pipe 22 is connected to the first port 21*c*. The second pipe 23 is connected to the second port 21*d*. The second port 21*d* is disposed above the first port 21*c*. Accordingly, the second port 21*d* is provided above the first port 21*c*.

The fixed member 31 having a cylindrical shape is housed inside the body 21. The fixed member 31 is provided within a range from the first port 21*c* to the second port 21*d*. One end 31*a* of the fixed member 31 on the first port 21*c* side is fixed to the body 21. A space between the one end 31*a* and the body 21 is sealed. A part of the injection valve 10, specifically, a part not including the distal end 10*a* is inserted into the fixed member 31. A predetermined clearance is formed between an inner circumferential surface of the fixed member 31 and an outer circumferential surface of the injection valve 10. This predetermined clearance forms a path of cooling water.

The movable member 33 having a cylindrical shape is housed inside the body 21. The movable member 33 is provided within a range from the distal end 10*a* of the injection valve 10 to the one end 31*a* of the fixed member 31. A part of the injection valve 10, specifically, a part including the distal end 10*a* is inserted into the movable member 33. The movable member 33 includes a first cylindrical portion 33*a*, a conical portion 33*b*, and a second cylindrical portion 33*c* positioned in an order from the distal end side (first end 21*a* side).

Each of the first cylindrical portion 33*a* and the second cylindrical portion 33*c* has a cylindrical shape. A diameter of the first cylindrical portion 33*a* is smaller than a diameter of the second cylindrical portion 33*c*. The conical portion 33*b* has a frusto-conical shape. The conical portion 33*b* connects the first cylindrical portion 33*a* and the second cylindrical portion 33*c*. A diameter of the conical portion 33*b* is enlarged from the first cylindrical portion 33*a* toward the second cylindrical portion 33*c*. A predetermined clearance is formed between respective inner circumferential surfaces of the first cylindrical portion 33*a*, the conical portion 33*b*, and the second cylindrical portion 33*c*, and the outer circumferential surface of the injection valve 10. This predetermined clearance forms a path of cooling water. Similarly, a predetermined clearance is formed between respective outer circumferential surfaces of the first cylindrical portion 33*a*, the conical portion 33*b*, and the second cylindrical portion 33*c*, and an inner circumferential surface of the body 21. This predetermined clearance forms a path of cooling water.

A first path is constituted by the predetermined clearance between the respective outer circumferential surfaces of the first cylindrical portion 33*a*, the conical portion 33*b*, and the second cylindrical portion 33*c*, and the inner circumferential surface of the body 21. The first path is connected to the first port 21*c*, and extends to an outer circumference of the distal end 10*a* of the injection valve 10. A second path is constituted by the predetermined clearance between the respective inner circumferential surfaces of the first cylindrical portion 33*a*, the conical portion 33*b*, the second cylindrical portion 33*c*, and the fixed member 31, and the outer circumferential surface of the injection valve 10. The second path is connected to the first path, extended from the outer circumference of the distal end 10*a* along the injection valve 10, and connected to the second port 21*d*. The first path and the second path constitute a coolant path.

A projection 33*d* formed at a boundary between the first cylindrical portion 33*a* and the conical portion 33*b* projects annularly toward the inner circumferential side. A clearance formed between the outer circumferential surface of the injection valve 10 and the inner circumferential surface of the projection 33*d* is smaller than each clearance at neighboring positions on both the upstream side and downstream side in the flow of cooling water. In other words, the projection 33*d* (throttling portion) reduces a passage area at a predetermined position in the second path to an area smaller than each passage area of neighboring positions of the predetermined position on both sides.

The first spring 35 is housed inside the first cylindrical portion 33*a*. The first spring 35 (regulating portion) is disposed between the outer circumferential surface of the injection valve 10 and the inner circumferential surface of the first cylindrical portion 33*a*. The first spring 35 is disposed between the first end 21*a* of the body 21 and the projection 33*d*. A clearance is formed between the outer circumferential surface of the injection valve 10 and the first spring 35, and a clearance is formed between the inner circumferential surface of the first cylindrical portion 33*a* and the first spring 35. The first spring 35 is constituted by a coil spring having a spring coefficient k1.

A medium diameter portion 10*c* having a diameter larger than a diameter of the distal end 10*a* is formed at an intermediate portion of the injection valve 10. The second spring 37 is disposed between the medium diameter portion 10*c* and the projection 33*d*. The second spring 37 (urging member) is constituted by a coil spring having a spring coefficient k2. One end of the second spring 37 is in contact with the medium diameter portion 10*c*, while the other end of the second spring 37 is in contact with the projection 33*d*. The second spring 37 urges the movable member 33 toward the distal end 10*a* of the injection valve 10 and the first end 21*a* of the body 21.

Accordingly, one end of the first spring 35 is in contact with the projection 33*d*, while the other end of the first spring 35 is in contact with the first end 21*a* of the body 21. The spring coefficient k1 of the first spring 35 is sufficiently larger than the spring coefficient k2 of the second spring 37 (k1>>k2). The first spring 35 therefore hardly contracts even when bring pressed by the projection 33*d*, wherefore, movement of the movable member 33 toward the first end 21*a* is regulated by the first spring 35.

A protrusion 33*cb* protruding annularly toward the outer circumferential side is formed on the second cylindrical portion 33*c* at a position close to the conical portion 33*b*. The second cylindrical portion 33*c* is slidably fitted to the one end 31*a* of the fixed member 31. No cooling water, or only a small amount of cooling water leaks from a space between the outer circumferential surface of the second cylindrical portion 33*c* and the inner circumferential surface of the one end 31*a* of the fixed member 31. An end surface of the one end 31*a* and the protrusion 33*cb* face each other.

The first port 21*c* faces the conical portion 33*b* of the movable member 33. Accordingly, cooling water introduced through the first port 21*c* collides with the outer circumferential surface of the conical portion 33*b* (first inclined surface). When a flow of cooling water collides with the outer circumferential surface of the conical portion 33*b*, a force generated by the collision shifts the movable member 33 toward the fixed member 31 side (side opposite to first end 21*a* of body 21). The force shifting the movable member 33 toward the fixed member 31 side increases as the flow amount of the cooling water colliding with the outer circumferential surface of the conical portion 33*b* increases.

FIG. 3 illustrates a state of the movable member 33 when the flow amount of the cooling water is smaller than a predetermined flow amount. In this case, the movable member 33 is urged toward the first end 21*a* side of the body 21 by the second spring 37, wherefore the projection 33*d* comes into contact with the first spring 35. Accordingly, movement of the movable member 33 toward the first end 21*a* side of the body 21 is regulated by the first spring 35. A first clearance g1 is formed between a distal end 33*aa* of the first cylindrical portion 33*a* and the first end 21*a* of the body 21.

An end surface of the one end 31*a* of the fixed member 31 and the protrusion 33*cb* are separated from each other.

Figure 4:
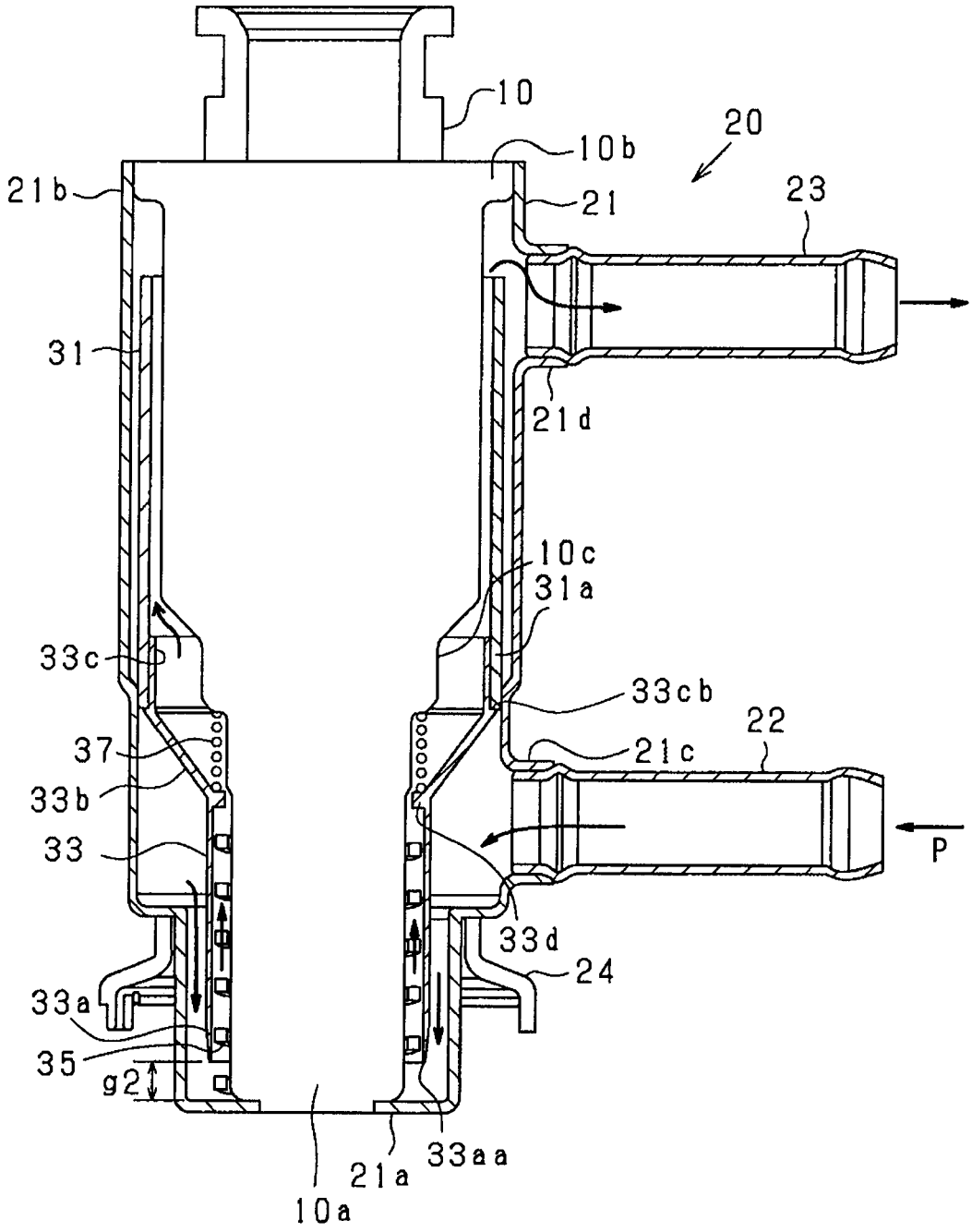
FIG. 4 is a partial cross-sectional view of FIG. 2 when a flow amount of cooling water is larger than the predetermined flow amount.

FIG. 4 illustrates a state of the movable member 33 when the flow amount of the cooling water is larger than the predetermined flow amount. As described above, when the flow of the cooling water collides with the outer circumferential surface of the conical portion 33*b*, a force generated by the collision shifts the movable member 33 toward the fixed member 31 side (side opposite to first end 21*a* of body 21). Accordingly, when the flow amount of the cooling water is larger than the predetermined flow amount, the movable member 33 is shifted toward the side opposite to the first end 21*a* of the body 21 (second port 21*d* side) while resisting the urging force of the second spring 37.

In this state, the end surface of the one end 31*a* of the fixed member 31 and the protrusion 33*cb* come into contact with each other. Accordingly, movement of the movable member 33 toward the fixed member 31 is regulated by the one end 31*a* of the fixed member 31.

A second clearance g2 is formed between the distal end 33*aa* of the first cylindrical portion 33*a* and the first end 21*a* of the body 21. The second clearance g2 is larger than the first clearance g1 (g2>g1). Accordingly, the outer circumferential surface of the conical portion 33*b* of the movable member 33 having received a flow of cooling water introduced from the first port 21*c* generates a force for shifting the movable member 33 in a direction of increasing a passage area of a portion between the distal end 10*a* of the injection valve 10 and the distal end 33*aa* of the movable member 33 (hereinafter referred to as "variable portion"). The variable portion (predetermined portion) is an outer circumferential portion of the distal end 10*a* of the injection valve 10 in the cooling water path (first path and second path).

The movable member 33 having received the flow of the cooling water shifts so that the passage area (defined by second clearance g2) of the variable portion in the state where the flow amount of the cooling water is larger the predetermined flow amount becomes larger than the passage area (defined by first clearance g1) of the variable portion in the state where the flow amount of the cooling water is smaller than the predetermined flow amount. The second spring 37 urges the movable member 33 in a direction of decreasing the passage area of the variable portion.

Furthermore, as described above, the clearance formed between the outer circumferential surface of the injection valve 10 and the inner circumferential surface of the projection 33*d* is a clearance smaller than each clearance of the neighboring positions on both the upstream side and downstream side in the flow of the cooling water. Accordingly, the projection 33*d* functions as a throttle portion formed in the second path. In this case, pressure of cooling water on the upstream side of the projection 33*d* becomes higher than pressure of cooling water on the downstream side of the projection 33*d*, generating a force for shifting the movable member 33 toward the fixed member 31 side. In other words, the projection 33*d* receiving a flow of cooling water generates a force for shifting the movable member 33 in the direction of increasing the passage area of the variable portion.

Figure 5:
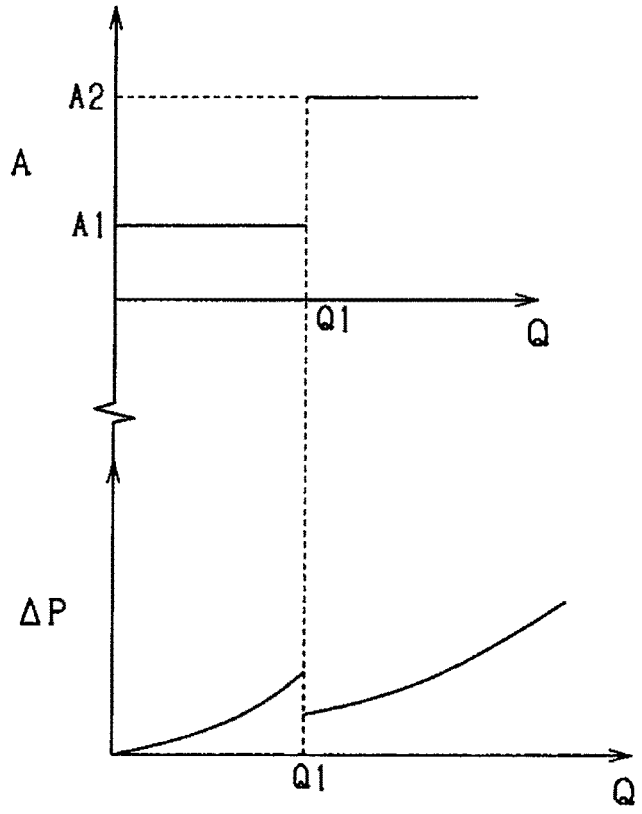
FIG. 5 is graph showing relationships between a flow amount of cooling water, an area of a variable portion, and a pressure loss in a normal flow.

FIG. 5 is a graph showing relationships between a flow amount Q of cooling water, an area A of the variable portion, and a pressure loss ΔP when cooling water flows in the normal direction.

In a state where a flow amount of cooling water is smaller than the flow amount Q1, the clearance of the variable portion is maintained at the first clearance g1, and the area of the variable portion is maintained at an area A1 as illustrated in FIG. 3. The movable member 33 is maintained at the position illustrated in FIG. 3 until the force for shifting the movable member 33 toward the fixed member 31 by the flow of cooling water becomes larger than a sum of the urging force of the second spring 37 and a frictional force acting on the movable member 33.

Suppose herein that the passage area of the variable portion has a fixed value (is unchangeable), the pressure loss ΔP of cooling water increases as the flow amount of cooling water increases. On the other hand, in a state where the passage area of the variable portion is excessively large, a pressure loss of cooling water drops, while a flow speed of cooling water decreases. In this case, cooling efficiency at the distal end 10*a* of the injection valve 10 lowers.

In this aspect, the clearance of the variable portion is enlarged to the second clearance g2 as illustrated in FIG. 4 when a flow amount of cooling water is larger than the flow amount Q1. Accordingly, the variable portion area increases to an area A2. More specifically, when a flow amount of cooling water becomes larger than the flow amount Q1, the force for shifting the movable member 33 toward the fixed member 31 side by the flow of the cooling water becomes larger than the sum of the urging force of the second spring 37 and the frictional force acting on the movable member 33.

The spring coefficient k2 of the second spring 37 is set to a relatively small value. Accordingly, the movable member 33 having started to shift continues shifting until the protrusion 33*cb* of the movable member 33 comes into contact with the one end 31*a* of the fixed member 31. As a result, the area of the variable portion increases to the area A2, wherefore the pressure loss ΔP decreases. At this time, a flow amount of cooling water flowing through the first path and the second path increases. Thereafter, the pressure loss ΔP increases as the flow amount of the cooling water increases.

The cooling device 20 is connected to the circulation circuit 60 of cooling water in parallel with the WCAC 50. In this case, a flow amount of cooling water flowing to the WCAC 50 decreases as a flow amount of cooling water flowing to the cooling device 20 increases. Accordingly, a proportion of cooling water distribution to the cooling device 20 increases, while a proportion of cooling water distribution to the WCAC 50 decreases.

Figure 6:
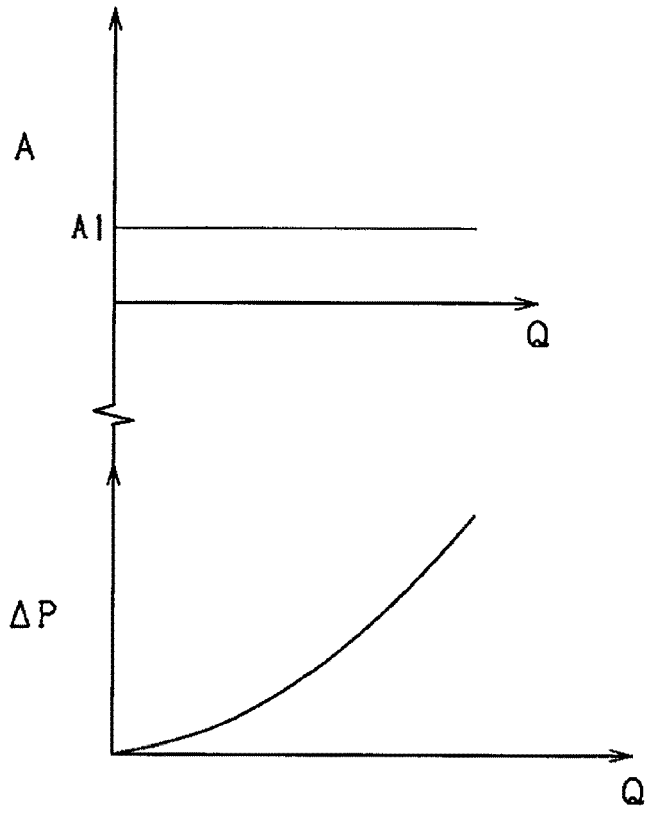
FIG. 6 is a graph showing relationships between the flow amount of cooling water, the area of the variable portion, and the pressure loss in an opposite flow.

FIG. 6 is a graph showing relationships between the flow amount Q of cooling water, the area A of the variable portion, and the pressure loss ΔP when cooling water flows in the opposite direction. The flow direction of cooling water flowing to the cooling device 20 is switchable to the opposite direction by using the switcher 52 described above.

When the cooling water flows in the opposite direction, the area of the variable portion is maintained at the area A1 regardless of the flow amount Q of cooling water. In this case, cooling water flows in a direction opposite to the normal direction indicated by arrows in FIG. 3. Therefore, a flow of cooling water collides with the inner circumferential surface of the conical portion 33*b* (second inclined surface). When the flow of the cooling water collides with the inner circumferential surface of the conical portion 33*b*, a force generated by the collision shifts the movable member 33 toward the first end 21*a* side of the body 21. In other words, the inner circumferential surface of the conical portion 33*b* having received the flow of the cooling water generates a force for shifting the movable member 33 in the direction of decreasing the passage area of the variable portion. In this case, the pressure loss ΔP increases as the flow amount of the cooling water increases.

Comparing FIG. 5 and FIG. 6, the movable member 33 having received a flow of cooling water shifts so that the area A2 of the variable portion in a state where the flow direction of cooling water is the normal direction becomes larger than the area A1 of the variable portion in a state where the flow direction of cooling water is the opposite direction. The flow amount of cooling water flowing in the normal direction toward the cooling device 20 becomes larger than the flow amount of cooling water flowing in the opposite direction toward the cooling device 20. In this case, the flow amount of cooling water flowing toward the WCAC 50 decreases. In other words, the flow amount of cooling water flowing in the opposite direction toward the cooling device 20 becomes smaller than the flow amount of cooling water flowing in the normal direction toward the cooling device 20. In this case, the flow amount of cooling water flowing toward the WCAC 50 increases. Accordingly, by supplying cooling water to the cooling device 20 in the opposite direction, the proportion of cooling water distribution to the cooling device 20 decreases, while the proportion of cooling water distribution to the WCAC 50 increases.

Figure 7:
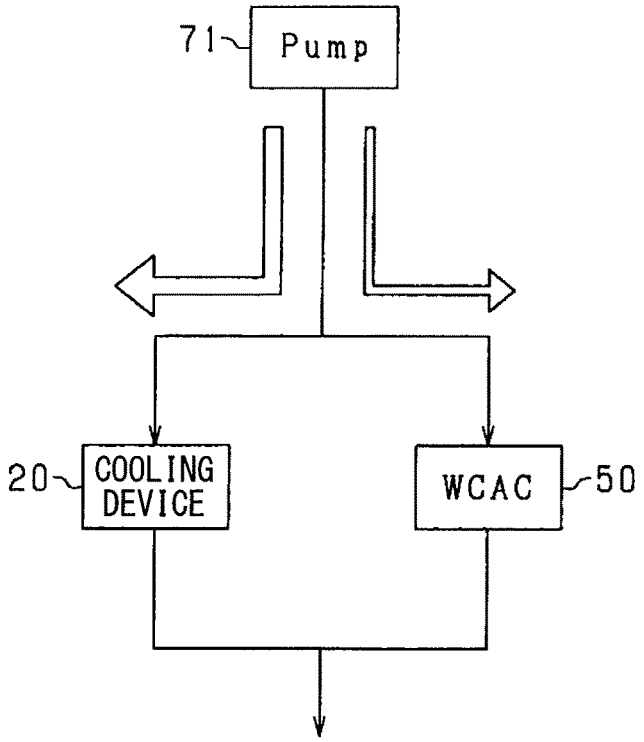
FIG. 7 is a schematic diagram illustrating proportions of cooling water distribution to the cooling device and to a water cooled charge air cooler (WCAC) in the normal flow.

FIG. 7 is a schematic diagram illustrating proportions of cooling water distribution to the cooling device 20 and to the WCAC 50 when cooling water flows in the normal direction. When a flow amount of cooling water is larger than the flow amount Q1, the proportion of cooling water distribution to the cooling device 20 is higher than the proportion of cooling water distribution to the WCAC 50. Accordingly, a flow amount of cooling water flowing to the cooling device 20 is larger than a flow amount of cooling water flowing to the WCAC 50.

Figure 8:
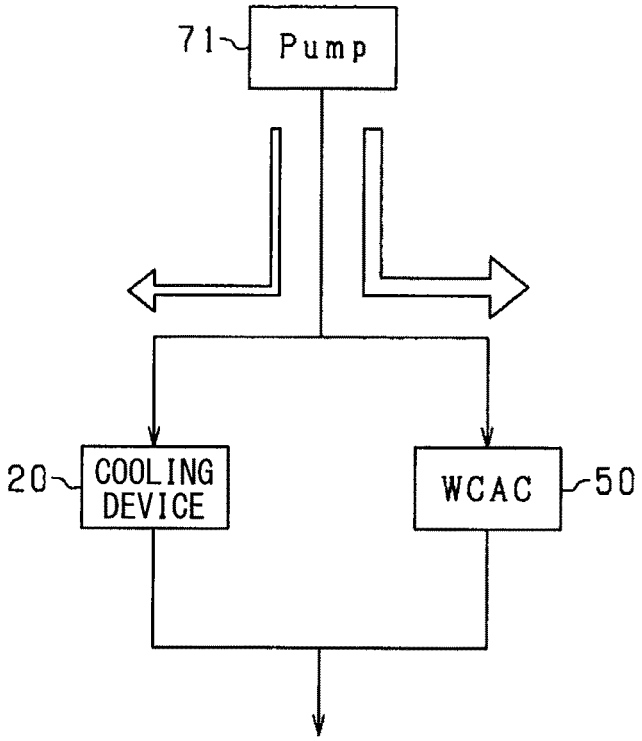
FIG. 8 is a schematic diagram illustrating proportions of cooling water distribution to the cooling device and to the WCAC in the opposite flow.

FIG. 8 is a schematic diagram illustrating proportions of cooling water distribution to the cooling device 20 and to the WCAC 50 when cooling water flows in the opposite direction. The proportion of cooling water distribution to the cooling device 20 is smaller than the proportion of cooling water distribution to the WCAC 50 regardless of a flow amount of cooling water. Accordingly, a flow amount of cooling water flowing to the cooling device 20 is smaller than a flow amount of cooling water flowing to the WCAC 50.

The present embodiment described above in detail has following advantages.

The movable member 33 having received a flow of cooling water shifts to vary the passage area of the variable portion of the cooling water path. Accordingly, a flow amount of cooling water flowing in the cooling water path is allowed to change in accordance with a flow of cooling water, whereby proportions of cooling water distribution to the cooling device and to the WCAC 50 are allowed to change. Furthermore, the movable member 33 which shifts by receiving the flow of the cooling water is capable of varying the passage area of the variable portion of the cooling water path by utilizing the flow of the cooling water.

The movable member 33 having received a flow of cooling water shifts so that the passage area of the variable portion in a state where the flow amount of the cooling water is larger than a predetermined flow amount becomes larger than the passage area of the variable portion in a state where the flow amount of the cooling water is smaller than the predetermined flow amount. Accordingly, reduction of a pressure loss of cooling water, and reduction of lowering of cooling efficiency are achievable. In this case, similarly to above, proportions of cooling water distribution to the cooling device for the injection valve 10 and to the WCAC 50 are allowed to change in accordance with the flow of the cooling water (more specifically, flow amount).

The outer circumferential surface of the conical portion 33*b* of the movable member 33 having received a flow of cooling water generates a force for shifting the movable member 33 in the direction of increasing the passage area of the variable portion. The force for shifting the movable member 33 increases as the flow amount of the cooling water colliding with the outer circumferential surface of the conical portion 33*b* increases. Accordingly, when the flow amount of the cooling water becomes larger than a predetermined flow amount and becomes sufficient for generating a large force for shifting the movable member 33, the passage area of the variable portion is allowed to increase.

The movable member 33 having received a flow of cooling water shifts so that the passage area of the variable portion in a state where the flow direction of cooling water is the normal direction becomes larger than the passage area of the variable portion in a state where the flow direction of cooling water is the opposite direction. Accordingly, proportions of cooling water distribution to the cooling device and to the WCAC 50 is allowed to change by switching the supply direction of cooling water to the coolant path between the normal direction and the opposite direction. In this case, similarly to above, proportions of cooling water distribution to the cooling device for the injection valve 10 and to the WCAC 50 are allowed to change in accordance with a flow of cooling water (more specifically, flow direction).

When the flow direction of cooling water is the opposite direction, the inner circumferential surface of the conical portion 33*b* of the movable member 33 having received a flow of cooling water generates a force for shifting the movable member 33 in the direction of decreasing the passage area of the variable portion. The force for shifting the movable member 33 increases as the flow amount of the cooling water colliding with the inner circumferential surface of the conical portion 33*b* increases. Accordingly, the passage area of the variable portion is easily maintained at a small area.

The passage area of the variable portion is easily maintained at a small area by the second spring 37 which urges the movable member 33 in the direction of decreasing the passage area of the variable portion.

The variable portion which varies the passage area in the cooling water path is the outer circumferential portion of the distal end 10*a* of the injection valve 10. In this case, a flow speed of cooling water flowing to the distal end 10*a* of the injection valve 10 is allowed to increase when the passage area of the variable portion decreases. Accordingly, efficient cooling is achievable for the distal end 10*a* of the injection valve 10 where a temperature increase easily occurs.

The projection 33*d* of the movable member 33 reduces the passage area at the predetermined position in the second path to an area smaller than each passage area of the neighboring positions on both sides of the predetermined position. In this case, pressure of cooling water on the upstream side of the projection 33*d* becomes higher than pressure of cooling water on the downstream side of the projection 33*d*, generating a force for shifting the movable member 33 toward the fixed member 31 side. In other words, the projection 33*d* receiving a flow of cooling water generates a force for shifting the movable member 33 in the direction of increasing the passage area of the variable portion. The force for shifting the movable member 33 increases as a flow amount of cooling water passing through the projection 33*d* increases. Accordingly, the projection 33*d* also generates a force for shifting the movable member 33 in the direction of increasing the passage area of the variable portion, thereby increasing the passage area of the movable portion when the flow amount of the cooling water is larger than the predetermined flow amount.

The embodiment described above may be modified in following manners. Parts identical to the parts in the embodiment described above are given identical reference numbers, and not repeatedly explained.

Figure 9:
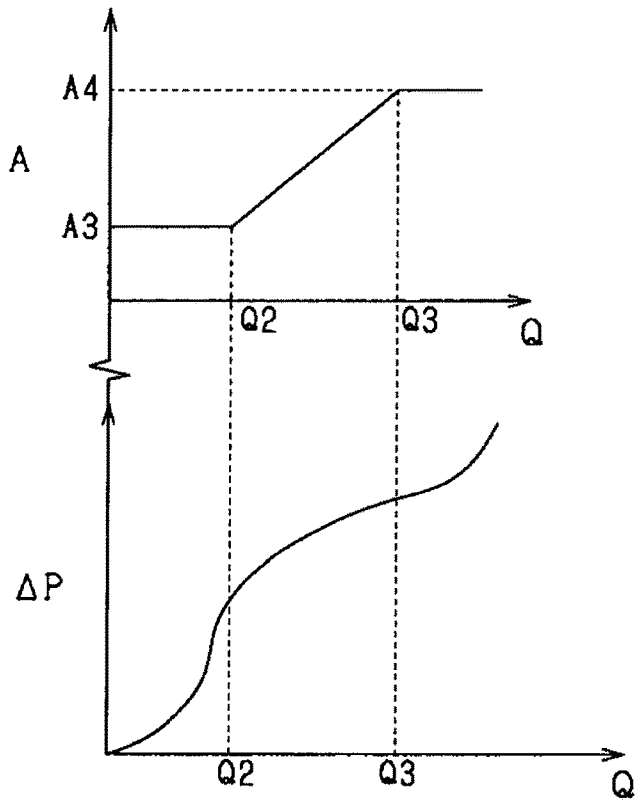
FIG. 9 is a graph showing relationships between the flow amount of cooling water, the area of the variable portion, and the pressure loss in the normal flow in a modified example.

FIG. 9 is a graph showing relationships between the flow amount Q of cooling water, the area A of the variable portion, and the pressure loss when cooling water flows in the normal direction according to a modified example. In this modified example, the movable member 33 having received a flow of cooling water shifts so that the passage area of the variable portion (predetermined portion) increases as the flow amount of the cooling water increases. More specifically, a spring coefficient k3 of the second spring 37 in this modified example is set to a value larger than the spring coefficient k2 and smaller than the spring coefficient k1 (k2<k3<k1). Accordingly, when the flow amount of the cooling water becomes larger than the flow amount Q2, the movable member 33 starts to shift toward the fixed member 31, and gradually shifts in accordance with the flow amount Q of the cooling water.

According to the above configuration, the movable member 33 having received the flow of the cooling water shifts so that the passage area of the variable portion increases as the flow amount of the cooling water increases. In this case, the passage area of the variable portion is allowed to gradually increase in accordance with the increase in the flow amount of the cooling water. Accordingly, reduction of a pressure loss of cooling water, and improvement of cooling efficiency are achievable.

Figure 10:
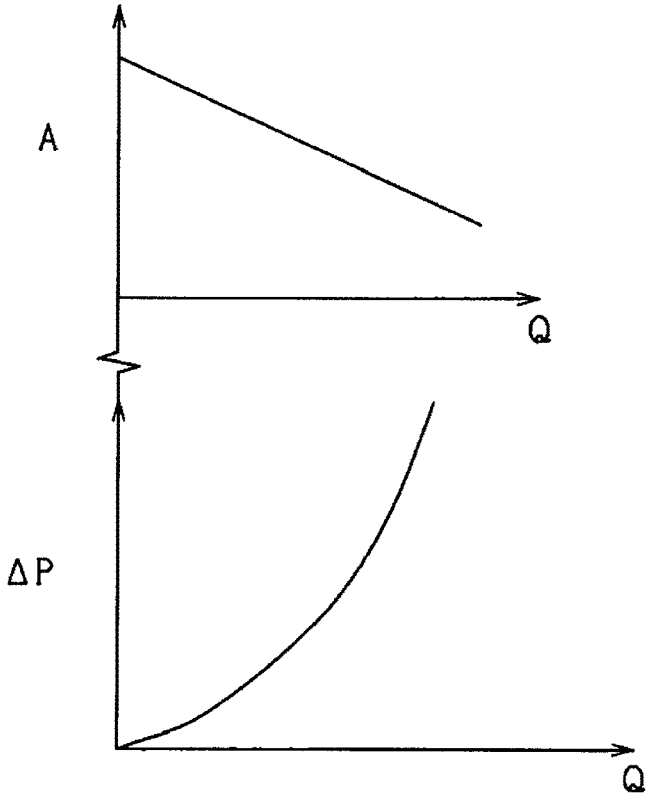
FIG. 10 is a graph showing relationships between the flow amount of cooling water, the area of the variable portion, and the pressure loss in the opposite flow in the modified example.

FIG. 10 is a graph showing relationships between the flow amount Q of cooling water, the area A of the variable portion, and the pressure loss when cooling water flows in the opposite direction according to a modified example. In this modified example, the movable member 33 having received a flow of cooling water shifts so that the passage area of the variable portion (predetermined portion) decreases as the flow amount of the cooling water increases in a state where the flow direction of the cooling water is the opposite direction. More specifically, a spring coefficient k4 of the first spring 35 in this modified example is set to a value larger than each of the spring coefficients k2 and k3 and smaller than the spring coefficient k1 (k2<k3<k4<k1). Accordingly, when the flow amount Q of the cooling water increases, the movable member 33 gradually shifts toward the first end 21*a* of the body 21 in accordance with the flow amount Q of the cooling water.

According to the above configuration, the movable member having received a flow of cooling water shifts so that the passage area of the variable portion decreases as the flow amount of the cooling water increases in the state where the flow direction of the cooling water is the opposite direction. In this case, the passage area of the variable portion is allowed to gradually decrease in accordance with the increase in the flow amount of the cooling water. Accordingly, the proportion of cooling water distribution to the WCAC 50 is allowed to increase as the flow amount of the cooling water increases.

An inclined surface (first inclined surface) which receives a flow of cooling water to generate a force for shifting the movable member 33 in the direction of increasing the passage area of the variable portion may be provided in addition to the outer circumferential surface of the conical portion 33*b*. The inclined surface may be a curved surface or a flat surface.

An inclined surface (second inclined surface) which receives a flow of cooling water to generate a force for shifting the movable member 33 in the direction of decreasing the passage area of the variable portion may be provided in addition to the inner circumferential surface of the conical portion 33*b*. The inclined surface may be a curved surface or a flat surface.

Figure 11:
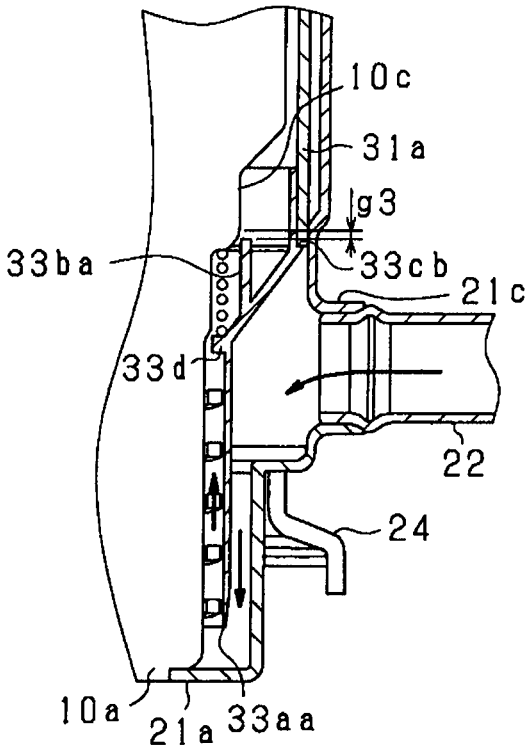
FIG. 11 is a partial cross-sectional view illustrating a movable member in a modified example.
Figure 12:
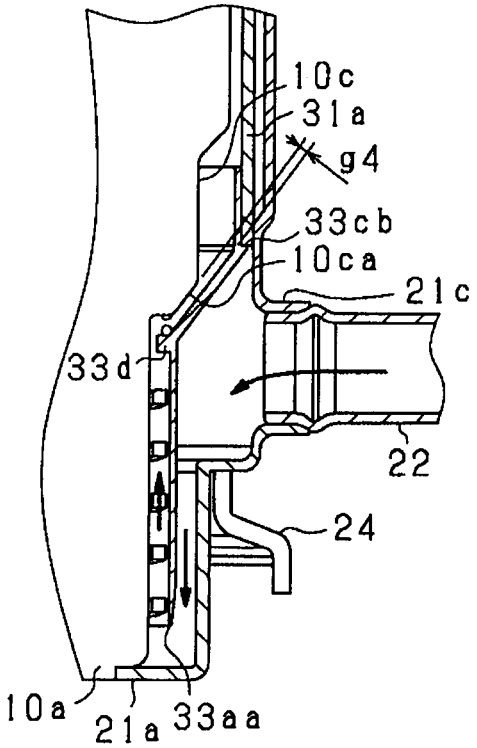
FIG. 12 is a partial cross-sectional view illustrating a movable member in another modified example.

As illustrated in FIGS. 11 and 12, a variable portion (predetermined portion) capable of varying a passage area may be provided in the cooling water path (the first path and the second path) in addition to the outer circumferential portion of the distal end 10*a* of the injection valve 10. FIG. 11 illustrates an annular portion 33*ba* formed inside the conical portion 33*b* of the movable member 33 and projecting annularly. A third clearance g3 of a portion (predetermined portion) between the medium diameter portion 10*c* of the injection valve 10 and the annular portion 33*ba* changes with a shift of the movable member 33 having received a flow of cooling water. This figure illustrates a state where the third clearance g3 is decreased. FIG. 12 illustrates an inclined portion 10*ca* having a conical shape and formed in the medium diameter portion 10*c* of the injection valve 10. A fourth clearance g4 of a portion (predetermined portion) between the inclined portion 10*ca* and the inner circumferential surface of the conical portion 33*b* changes with a shift of the movable member 33 having received a flow of cooling water. This figure illustrates a state where the fourth clearance g4 is decreased.

The second spring 37 may be eliminated when the passage area of the variable portion is allowed to decrease by gravity acting on the movable member 33 in a state where a flow amount of cooling water is smaller than the predetermined flow amount.

In place of the WCAC 50, an exhaust gas recirculation (EGR) cooler, a turbocharger, or the like (different cooling device) may be connected to the branch path 61.

The cooling device 20 for the injection valve 10 may adopt a coolant other than cooling water as a cooling medium.

The injection valve 10 may inject an additive other than urea, such as fuel or other reducing agents.

In a comparison example where a cooling device is connected to a different cooling device in parallel in a certain situation, proportions of cooling water distributed to the cooling device and to the different cooling device are not allowed to change in accordance with a flow of the cooling water.

The present disclosure provides a cooling device for an additive injection valve, the cooling device being connected to a circulation circuit for cooling water in parallel with a different cooling device, and capable of changing proportions of cooling water distributed to the cooling device and to the different cooling device in accordance with a flow of the cooling water.

Specifically, the cooling device according to the present disclosure is, for an additive injection valve, connected to a circulation circuit of coolant in parallel with a different cooling device, and includes: a coolant path through which the coolant flows; and a movable member that receives a flow of the coolant and shifts to vary a passage area of a predetermined portion of the coolant path.

According to the above configuration, the cooling device is connected to the circulation circuit of the coolant in parallel with the different cooling device. The cooling device includes the coolant path through which the coolant flows. In this case, a flow amount of the coolant flowing through the coolant path of the cooling device changes to change proportions of coolant distribution to the cooling device and to the different cooling device.

The movable member having received a flow of the coolant shifts to vary the passage area of the predetermined portion of the coolant path. Accordingly, a flow amount of the coolant flowing in the coolant path is allowed to change in accordance with a flow of the coolant, whereby proportions of cooling water distribution to the cooling device and to the different cooling device are allowed to change. Furthermore, the movable member which shifts by receiving the flow of the coolant is capable of varying the passage area of the predetermined portion of the coolant path by utilizing the flow of the coolant.

The cooling device for the additive injection valve is connected to the circulation circuit for coolant in parallel with a different cooling device. The cooling device includes: a coolant path through which the coolant flows; and a movable member that receives a flow of the coolant and shifts to vary a passage area of a predetermined portion of the coolant path. The movable member may cause the passage area of the predetermined portion when a flow amount of the coolant is larger than a predetermined flow amount to be larger than the passage area of the predetermined portion when the flow amount of the coolant is smaller than the predetermined flow amount.

Suppose herein that the passage area of the coolant path has a fixed value (is unchangeable), the pressure loss of coolant increases as the flow amount of coolant increases. On the other hand, in a state where the passage area of the coolant path is excessively large, a pressure loss of coolant drops, while a flow speed of coolant decreases. In this case, the cooling efficiency lowers.

According to the embodiment, the movable member having received a flow of coolant shifts so that the passage area of the predetermined portion in a state where the flow amount of the coolant is larger than a predetermined flow amount becomes larger than the passage area of the predetermined portion in a state where the flow amount of the coolant is smaller than the predetermined flow amount. Accordingly, reduction of a pressure loss of cooling water, and reduction of lowering of cooling efficiency are achievable. In this case, proportions of coolant distribution to the cooling device for the injection valve and to the different cooling device are allowed to change in accordance with the flow (more specifically, flow rate) of the coolant.

For example, the movable member may cause the passage area of the predetermined portion to increase as the flow amount of the coolant increases.

According to the above configuration, the movable member having received the flow of the coolant shifts so that the passage area of the predetermined portion increases as the flow amount of the coolant increases. In this case, the passage area of the predetermined portion is allowed to gradually increase in accordance with the increase in the flow amount of the coolant. Accordingly, reduction of a pressure loss of coolant, and improvement of cooling efficiency are achievable.

For example, the movable member may include a first inclined surface that receives a flow of the coolant to generate a force for shifting the movable member in a direction of increasing the passage area of the predetermined portion.

The first inclined surface of the movable member having received a flow of coolant generates a force for shifting the movable member in the direction of increasing the passage area of the predetermined portion. The force for shifting the movable member increases as the flow amount of the coolant colliding with the first inclined surface of the movable member increases. Accordingly, when the flow amount of the coolant becomes larger than a predetermined flow amount and becomes sufficient for generating a large force for shifting the movable member, the passage area of the predetermined portion is allowed to increase.

For example, the movable member may cause the passage area of the predetermined portion when a flow direction of the coolant is a first direction to be larger than the passage area of the predetermined portion when the flow direction of the coolant is a second direction opposite to the first direction.

The movable member having received a flow of coolant shifts so that the passage area of the predetermined portion in a state where the flow direction of coolant is the normal direction becomes larger than the passage area of the predetermined portion in a state where the flow direction of coolant is the opposite direction. Accordingly, proportions of coolant distribution to the cooling device and to the different cooling device are allowed to change by switching the supply direction of coolant to the coolant path between the normal (first) direction and the opposite (second) direction. In this case, similarly to above, proportions of coolant distribution to the cooling device for the injection valve and to the different cooling device are allowed to change in accordance with a flow (more specifically, flow direction) of coolant.

For example, the movable member may cause the passage area of the predetermined portion to decrease as the flow amount of the coolant increases when the flow direction of the coolant is the second direction.

According to the above configuration, the movable member having received a flow of coolant shifts so that the passage area of the predetermined portion decreases as the flow amount of the coolant increases in the state where the flow direction of the coolant is the opposite (second) direction. In this case, the passage area of the predetermined portion is allowed to gradually decrease in accordance with the increase in the flow amount of the coolant. Accordingly, the proportion of coolant distribution to the different cooling devic is allowed to increase as the flow amount of the coolant increases.

For example, the movable member may include a second inclined surface that receives a flow of the coolant to generate a force for shifting the movable member in a direction of decreasing the passage area of the predetermined portion.

The second inclined surface of the movable member having received a flow of coolant generates a force for shifting the movable member in the direction of decreasing the passage area of the predetermined portion. The force for shifting the movable member increases as the flow amount of the coolant colliding with the second inclined surface of the movable member increases. Accordingly, the passage area of the predetermined portion is easily maintained at a small area, or the passage area of the predetermined portion can be reduced as the flow rate of coolant is larger.

For example, the cooling device may further include an urging member that urges the movable member in a direction of decreasing the passage area of the predetermined portion.

The passage area of the predetermined portion is easily maintained at a small area by the urging member which urges the movable member in the direction of decreasing the passage area of the predetermined portion. Accordingly, the passage area of the predetermined portion is easily maintained at a small area.

For example, the predetermined portion is an outer circumferential portion of a distal end of the additive injection valve in the coolant path.

The predetermined portion which varies the passage area in the coolant path is the outer circumferential portion of the distal end of the injection valve. In this case, a flow speed of coolant flowing to the distal end of the injection valve is allowed to increase when the passage area of the predetermined portion decreases. Accordingly, efficient cooling is achievable for the distal end of the injection valve where a temperature increase easily occurs.

For example, the cooling system includes: the cooling device for the additive injection valve; and a different cooling device connected to the circulation circuit of the coolant in parallel with the cooling device for the additive injection valve. The above-described advantages can be obtained in the cooling system including the cooling devices.

Such changes and modifications are to be understood as being within the scope of the present disclosure as defined by the appended claims.

What is claimed is:

1. A cooling device for an additive injection valve, the cooling device being connected to a circulation circuit for coolant in parallel with a different cooling device, the cooling device comprising:

a coolant path through which the coolant flows; and a movable member that receives a flow of the coolant and shifts to vary a passage area of a predetermined portion of the coolant path.

2. The cooling device for the additive injection valve according to claim 1, wherein the movable member causes the passage area of the predetermined portion when a flow amount of the coolant is larger than a predetermined flow amount to be larger than the passage area of the predetermined portion when the flow amount of the coolant is smaller than the predetermined flow amount.

3. The cooling device for the additive injection valve according to claim 1, wherein the movable member causes the passage area of the predetermined portion to increase as the flow amount of the coolant increases.

4. The cooling device for the additive injection valve according to claim 1, wherein the movable member includes a first inclined surface that receives a flow of the coolant to generate a force for shifting the movable member in a direction of increasing the passage area of the predetermined portion.

5. The cooling device for the additive injection valve according to claim 1, wherein the movable member causes the passage area of the predetermined portion when a flow direction of the coolant is a first direction to be larger than the passage area of the predetermined portion when the flow direction of the coolant is a second direction opposite to the first direction.

6. The cooling device for the additive injection valve according to claim 5, wherein the movable member causes the passage area of the predetermined portion to decrease as the flow amount of the coolant increases when the flow direction of the coolant is the second direction.

7. The cooling device for the additive injection valve according to claim 1, wherein the movable member includes a second inclined surface that receives a flow of the coolant to generate a force for shifting the movable member in a direction of decreasing the passage area of the predetermined portion.

8. The cooling device for the additive injection valve according to claim 1, further comprising an urging member that urges the movable member in a direction of decreasing the passage area of the predetermined portion.

9. The cooling device for the additive injection valve according to claim 1, wherein the predetermined portion is an outer circumferential portion of a distal end of the additive injection valve in the coolant path.

10. A cooling system comprising:

the cooling device for the additive injection valve according to claim 1; and a different cooling device connected to the circulation circuit in parallel with the cooling device for the additive injection valve.

* * * * *